US008480507B2

(12) United States Patent
Finn et al.

(10) Patent No.: US 8,480,507 B2
(45) Date of Patent: Jul. 9, 2013

(54) GOLF CLUBS AND GOLF CLUB HEADS

(75) Inventors: Michael E. Finn, Fort Worth, TX (US); Hiroshi Kawaguchi, Fort Worth, TX (US); Naoki Kobayashi, Tokyo (JP); Tony Dabbs, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 7 days.

(21) Appl. No.: 13/214,895

(22) Filed: Aug. 22, 2011

(65) Prior Publication Data

US 2012/0157223 A1 Jun. 21, 2012

Related U.S. Application Data

(60) Provisional application No. 61/375,558, filed on Aug. 20, 2010.

(51) Int. Cl.
*A63B 53/00* (2006.01)

(52) U.S. Cl.
USPC ..... 473/291

(58) Field of Classification Search
USPC ..... 473/291
See application file for complete search history.

(56) References Cited

U.S. PATENT DOCUMENTS

| | | | | |
|---|---|---|---|---|
| 4,923,197 | A | 5/1990 | Schacht | |
| 5,380,004 | A | 1/1995 | Teramoto et al. | |
| 5,433,439 | A | 7/1995 | Hsien | |
| 5,735,754 | A | 4/1998 | Antonious | |
| 5,800,281 | A | 9/1998 | Gilbert | |
| 5,984,803 | A | 11/1999 | Chappell | |
| 6,027,415 | A | 2/2000 | Takeda | |
| 6,089,990 | A | 7/2000 | Kimura | |
| 6,183,376 | B1 | 2/2001 | Peters et al. | |
| 6,290,607 | B1 * | 9/2001 | Gilbert et al. | 473/291 |
| 6,723,005 | B2 | 4/2004 | Hueber | |
| 6,780,123 | B2 | 8/2004 | Hasebe | |
| 6,830,519 | B2 | 12/2004 | Reed et al. | |
| 6,908,399 | B1 | 6/2005 | Henry | |
| 2004/0121852 | A1 | 6/2004 | Tsurumaki | |

(Continued)

FOREIGN PATENT DOCUMENTS

| | | |
|---|---|---|
| EP | 517487 | 9/1992 |
| GB | 2288984 | 8/1995 |

OTHER PUBLICATIONS

International Search Report, dated May 10, 2012, for PCT/US2011/048656.

(Continued)

*Primary Examiner* — Michael Dennis
(74) *Attorney, Agent, or Firm* — Banner & Witcoff, Ltd.

(57) ABSTRACT

A set of golf clubs in accordance with at least some examples of this disclosure may include one or more iron-type golf club heads with a slot, or pocket cavity, behind the ball striking face of the golf club head. Further, one or more of the golf clubs in the set may include iron-type golf club heads with a split cavity or half cavity configuration. Additionally, one or more of the golf clubs in the set may include iron-type golf club heads of the blade-type. Also, one or more of the golf clubs in the set may include a hybrid-type golf club head with a cavity, or compression channel, extending through the bottom surface of the club head behind the ball striking face of the golf club head and one or more additional cavities extending through a bottom surface of the club head.

12 Claims, 7 Drawing Sheets

U.S. PATENT DOCUMENTS

| | | | | |
|---|---|---|---|---|
| 2004/0147335 | A1* | 7/2004 | Iwata et al. | 473/291 |
| 2004/0192463 | A1 | 9/2004 | Tsurumaki et al. | |
| 2005/0085312 | A1 | 4/2005 | Nagai et al. | |
| 2005/0239572 | A1 | 10/2005 | Roach et al. | |
| 2009/0124410 | A1 | 5/2009 | Rife | |
| 2011/0159981 | A1* | 6/2011 | Bazzel et al. | 473/291 |
| 2011/0201443 | A1* | 8/2011 | Best et al. | 473/291 |
| 2012/0100925 | A1* | 4/2012 | Soracco et al. | 473/291 |

OTHER PUBLICATIONS

ISR/WO from PCT Application No. PCT/US2011/048656 mailed May 10, 2012.

* cited by examiner

GOLF CLUBS AND GOLF CLUB HEADS

CROSS-REFERENCE TO RELATED APPLICATIONS

This application is a non-provisional application which claims priority to U.S. Provisional Application Ser. No. 61/375,558, filed Aug. 20, 2010, the disclosure of which is hereby incorporated by reference in its entirety.

FIELD OF THE DISCLOSURE

The present disclosure relates to golf clubs and golf club heads. Particular example aspects of this disclosure relate to a set of golf clubs with different types of golf club heads.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, there is room in the art for further advances in golf club technology.

SUMMARY OF THE DISCLOSURE

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Golf club heads according to at least some example aspects of this disclosure include: an iron-type golf club head having a ball striking face and a rear surface opposite the ball striking face (e.g., including a perimeter weighting member extending rearward from the ball striking face and along at least a portion of a circumferential area of the golf club head). Also, the golf club head may include a slot, or "pocket cavity", behind the ball striking face of the golf club head.

Further, other golf club heads according to at least some example aspects of this disclosure include: an iron-type golf club head having a ball striking face and a rear surface opposite the ball striking face (e.g., including a perimeter weighting member extending rearward from the ball striking face and along at least a portion of a circumferential area of the golf club head). Also, the golf club head may include a "split cavity" or "half cavity" configuration, which will be described in detail below.

Additionally, other golf club heads according to at least some example aspects of this disclosure include: an iron-type golf club head having a ball striking face and a rear surface opposite the ball striking face. Also, the golf club head may be a blade type iron.

Also, other golf club heads according to at least some example aspects of this disclosure include: a hybrid-type golf club head having a ball striking face and a rear surface opposite the ball striking face. Also, the golf club head body may include a cavity, or compression channel, extending through a bottom surface of the club head body behind the ball striking face of the golf club head. Further, the golf club head body may include one or more additional cavities extending through a bottom surface of the club head.

A set of golf clubs in accordance with at least some examples of this disclosure may include one, some or all of the above described golf club heads. For example, one or more of the golf clubs in the set may include iron-type golf club heads with the slot, or pocket cavity, behind the ball striking face of the golf club head. Further, one or more of the golf clubs in the set may include iron-type golf club heads with the split cavity or half cavity configuration. Additionally, one or more of the golf clubs in the set may include iron-type golf club heads of the blade-type. Also, one or more of the golf clubs in the set may include a hybrid-type golf club head with a cavity, or compression channel, extending through the bottom surface of the club head behind the ball striking face of the golf club head and one or more additional cavities extending through a bottom surface of the club head.

Additional aspects of this disclosure relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight members; etc.

Still additional aspects of this disclosure relate to methods for producing golf club heads and golf club structures, e.g., of the types described above. Such methods may include, for example: (a) providing a golf club head of the various types described above, e.g., by manufacturing or otherwise constructing the golf club head body, by obtaining the golf club head body from another source, etc.; and (b) engaging a shaft member with the golf club head. Other steps also may be included in these methods, such as engaging a grip member with the shaft member, club head body finishing steps, etc.

BRIEF DESCRIPTION OF THE DRAWINGS

The present disclosure is illustrated by way of example and not limited in the accompanying figures, in which like reference numerals indicate similar elements throughout, and in which.

Figure 1:
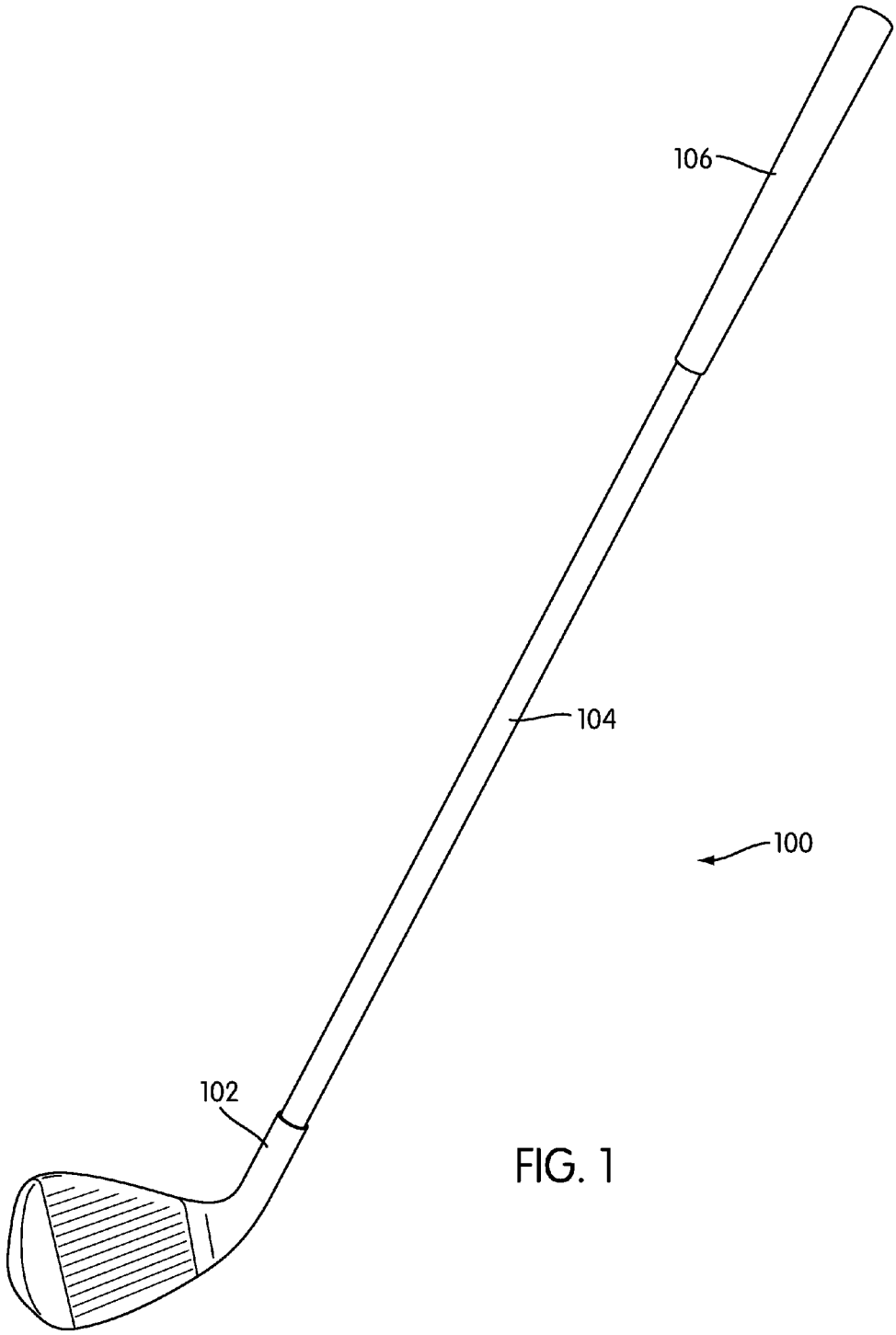
FIG. 1 generally illustrates features of a golf club structure according to at least some examples of this disclosure.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

I. General Description of Example Golf Club Heads, Golf Clubs, and Methods in Accordance with this Disclosure As described above, aspects of this disclosure relate to iron-type golf club heads and golf clubs. Iron-type golf club heads according to at least some example aspects of this disclosure may include: (a) a ball striking face; (c) a golf club head body include a rear surface opposite the ball striking face, including a perimeter weighting member extending in a direction rearward from the ball striking face and along at least a portion of a circumferential area of the golf club head body; and (c) a slot, or pocket cavity, defined, at least in part, by the ball striking face and golf club head body, wherein the slot, or pocket cavity, is positioned behind the ball striking face of the golf club head.

According to some aspects of this disclosure, "long" iron-type golf clubs (i.e., irons with a relatively low degree of loft, e.g., 3-iron, 4-iron) in the set of golf clubs according to aspects of the disclosure may be configured with the slot, or pocket cavity, behind the ball striking face of the golf club head. As will be described in detail below, the configuration of such pocket cavity irons may provide a center of gravity of the golf club head which is low, away from the ball striking face of the golf club head and which is more centered relative to the center of the face of the golf club head. Further, as will be described in detail below, the pocket cavity configuration may provide a golf club head that is "forgiving" when the golf ball is not struck with the sweet spot of the golf club head (e.g., the errant trajectory of the golf ball when it is struck off-center of the face of the golf club head may be minimized).

Other iron-type golf club heads according to at least some example aspects of this disclosure may include: (a) an iron-type golf club head body; (b) a ball striking face; and (c) a rear surface opposite the ball striking face, including a perimeter weighting member extending rearward from the ball striking face and along at least a portion of a circumferential area of the golf club head body. Further, the golf club head may include the split cavity or half cavity configuration which will be described in detail below.

According to some aspects of this disclosure, "middle" iron-type golf clubs (i.e., irons with a relatively intermediate degree of loft, e.g., a 5-iron, 6-iron, 7-iron) of the set of golf clubs according to aspects of the disclosure may be configured with the split cavity or half cavity structure. As will be described in detail below, such a configuration may provide a center of gravity of the golf club head which relatively low, away from the ball striking face of the golf club head and which is more centered relative to the center of the face of the golf club head.

Further, as will be described in detail below, such a configuration may provide a relative compromise between the forgiveness of the above described pocket cavity iron-type golf club heads (or, even, cavity backed iron-type golf club heads in general) and the feel, control and workability (e.g., the ability to control the trajectory of the golf shot) of the blade type irons described below.

Other, iron-type golf club heads according to at least some example aspects of this disclosure may include: (a) an iron-type golf club head body; (b) a ball striking face; (c) a rear surface opposite the ball striking face. Further, the iron-type golf club head may be a blade type iron (or simply a "blade").

It is noted that a blade may have a smaller sweet spot compared with the larger sweet spot of the cavity back irons in which the perimeter weighting minimizes the extent of the errant trajectories during off-center shots. Therefore, it may be more difficult to make contact with the sweet spot in a blade. However, because a blade distributes the mass and weight of the golf club head more evenly throughout the golf club head, the blade may provide a golfer with better "feel" and more workability or, control over the trajectory of the shot, than a cavity back iron-type golf club head. This feature of blade-type irons may be particularly advantageous in short irons wherein control and feel is particular useful.

Hence, according to some aspects of this disclosure, "short" iron-type golf clubs (i.e., irons with a relatively high degree of loft, e.g., an 8-iron, 9-iron, 10-iron, a pitching wedge, a sand wedge, a gap wedge, a lob wedge, etc.) of the set of golf clubs according to aspects of the disclosure may be configured with as a blade-type iron.

As described above, aspects of this disclosure relate to hybrid-type golf club heads and golf clubs. Hybrid-type golf club heads according to at least some example aspects of this disclosure may include: (a) an hybrid-type golf club head body; (b) a ball striking face; (c) a rear surface opposite the ball striking face. Also, the golf club head body may include a cavity, or compression channel, extending through a bottom surface of the club head behind the ball striking face of the golf club head. Further, the golf club head body may include one or more additional cavities or notches extending through a bottom surface of the club head body.

As will be described in detail below, such a configuration may allow the club head to compress during impact with the golf ball and, thereby, lower the loft of the club in order to increase launch on center shot of face. Therefore, such a configuration of the golf club head may be particularly useful in maximizing the distance of the golf shot.

Additional aspects of this disclosure relate to iron-type and hybrid-type golf club structures that include golf club heads, e.g., of the types described above. Such iron-type and hybrid-type golf club structures further may include one or more of: a shaft member attached to the club head (optionally via a separate hosel member or a hosel member provided as a part of one or more of the club head and/or shaft); a grip or handle member attached to the shaft member; additional weight members; medallions; etc.

Still additional aspects of this disclosure relate to methods for producing iron-type and hybrid-type golf club heads and iron-type and hybrid-type golf club structures in accordance with examples of this disclosure. Such methods may include, for example, one or more of the following steps in any desired order and/or combinations: (a) providing a golf club head body of the various types described above (including any or all of the various structures, features, and/or arrangements described above), e.g., by manufacturing or otherwise constructing the golf club head body, by obtaining it from a third party source, etc.; (b) engaging a shaft member with the golf club head body; and (c) engaging a grip member with the shaft member.

Still additional aspects of this disclosure relate to a set of golf clubs which may include one, some or all of the above described golf club heads. For example, one or more of the "long" irons in the set may include iron-type golf club heads with the slot, or pocket cavity, behind the ball striking face of the golf club head. Further, one or more of the "middle" irons in the set may include iron-type golf club heads with the split cavity or half cavity configuration. Additionally, one or more of the "short" irons in the set may include iron-type golf club heads of the blade type. Also, one or more of the golf clubs in the set may include a hybrid-type golf club head with a cavity, or compression channel, extending through the bottom surface of the club head behind the ball striking face of the golf club head. Further, the hybrid type golf club head body may include one or more additional cavities or notches extending through a bottom surface of the club head body.

Given the general description of various example aspects of the disclosure provided above, more detailed descriptions of various specific examples of golf clubs and golf club head structures according to the disclosure are provided below.

II. Detailed Description of Example Golf Club Heads, Golf Club Structures, and Methods According to the Disclosure The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

More specific examples and features of iron-type golf club heads and golf club structures according to this disclosure will be described in detail below in conjunction with the example golf club structures illustrated in FIGS. 1-10.

FIG. 1 generally illustrates an example of an iron-type golf club 100 in accordance with the present disclosure. The overall golf club structure 100 of this example includes, a hosel 102, a shaft 104 received in and/or inserted into and/or through the hosel 102, a grip or handle 106 attached to the shaft 104 and a golf club head. Optionally, if desired, the external hosel 102 may be eliminated and the shaft 104 may be directly inserted into and/or otherwise attached to the golf club head (e.g., through an opening provided in the top of the golf club head, through an internal hosel (e.g., provided within an interior chamber defined by the golf club head), etc.). The hosel 102 may be integrally formed as part of the golf club head structure, or it may be separately formed and engaged therewith (e.g., by adhesives or cements; by welding, brazing, soldering, or other fusing techniques; by mechanical connectors; etc.). Conventional hosels and their inclusion in an iron-type golf club head structure may be used without departing from this disclosure.

The shaft 104 may be received in, engaged with, and/or attached to the golf club head in any suitable or desired manner, including in conventional manners known and used in the art, without departing from the disclosure. As more specific examples, the shaft 104 may be engaged with the golf club head via a hosel 102 and/or directly to the golf club head structure 102, e.g., via adhesives, cements, welding, soldering, mechanical connectors (such as threads, retaining elements, or the like), etc.; through a shaft-receiving sleeve or element extending into the golf club head; etc. If desired, the shaft 104 may be connected to the golf club head in a releasable manner using mechanical connectors to allow easy interchange of one shaft for another on the head.

The shaft 104 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member (not shown) may be attached to, engaged with, and/or extend from the shaft 104 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member 106 may be integrally formed as a unitary, one-piece construction with the shaft 104. Additionally, any desired grip or handle materials may be used without departing from this disclosure, including, for example: rubber materials, leather materials, rubber or other materials including cord or other fabric material embedded therein, polymeric materials, and the like.

The golf club head itself also may be constructed in any suitable or desired manner and/or from any suitable or desired materials without departing from this disclosure, including from conventional materials and/or in conventional manners known and used in the art. For example, as seen in the example structure shown in FIG. 1, the golf club head club head may include a top, or crown, and a sole. The golf club head and/or its various parts may be made by forging, casting, molding, and/or using other techniques and processes, including techniques and processes that are conventional and known in the art.

A wide variety of overall club head constructions are possible without departing from this disclosure. For example, if desired, some or all of the various individual parts of the golf club head described above may be made from multiple pieces that are connected together (e.g., by adhesives or cements; by welding, soldering, brazing, or other fusing techniques; by mechanical connectors; etc.). The various parts (e.g., crown, sole, etc.) may be made from any desired materials and combinations of different materials, including materials that are conventionally known and used in the art, such as metal materials, including lightweight metal materials, composite materials, polymer materials, etc.

The dimensions and/or other characteristics of a golf club head structure according to examples of this disclosure may vary significantly without departing from the disclosure. For example, any iron-type club head may be provided including, for example: iron-type hybrid clubs, driving irons, 0 through 10 irons, wedges (e.g., pitching wedges, lob wedges, gap wedges, sand wedges, etc.), chipping clubs, etc.

According to aspects of the disclosure, the golf club head may be one of several different embodiments that will be described in detail below. For example, one embodiment of the golf club head according to aspects of the disclosure may be the iron-type golf club head with the slot, or pocket cavity, behind the ball striking face of the golf club head. Further, another embodiment of the golf club head according to aspects of the disclosure may include the iron-type golf club head with the split cavity or half cavity configuration. Additionally, another embodiment of the golf club head according to aspects of the disclosure may be the iron-type golf club head of the blade-type. Each of these embodiments will be described in detail below.

Figure 2:
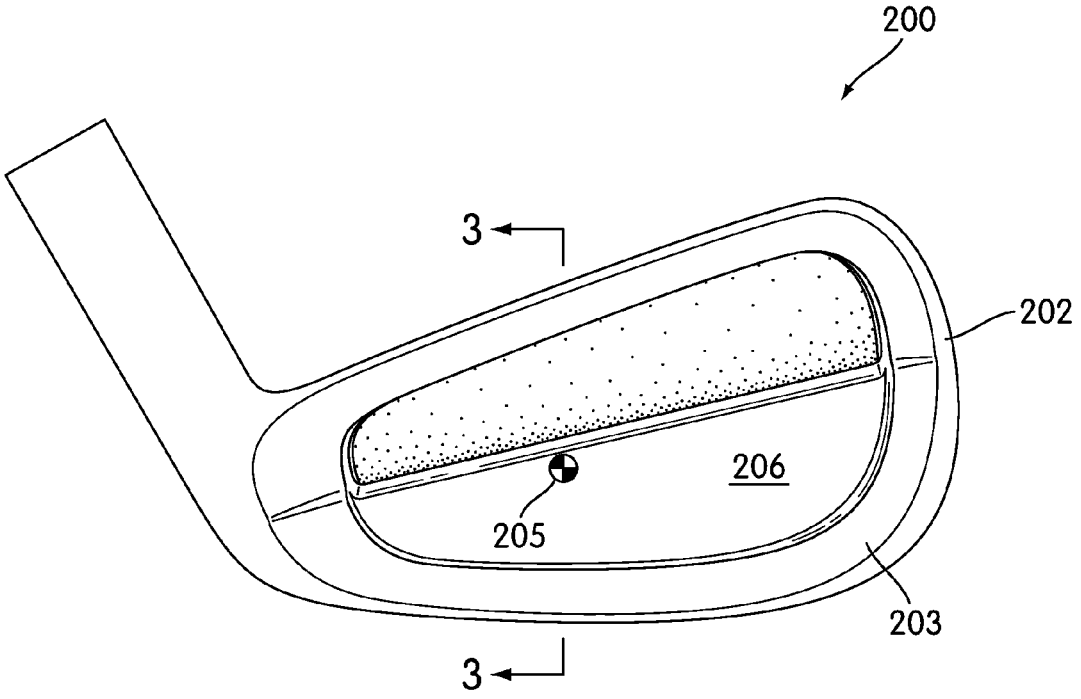
FIG. 2 illustrates a golf club head structure according to at least some examples of this disclosure.
Figure 3:
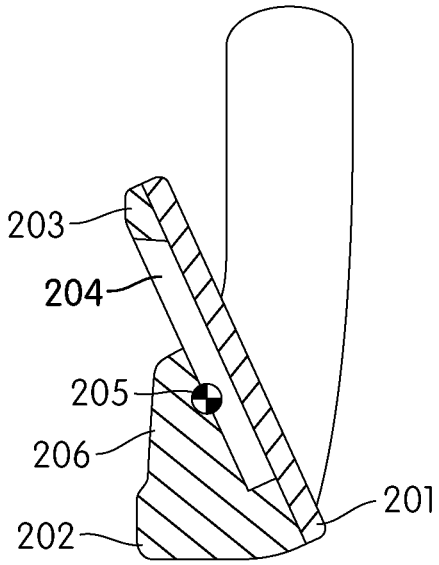
FIG. 3 illustrates cross sectional view of the golf club head structure shown in FIG. 2 taken along line 3-3.
Figure 4:
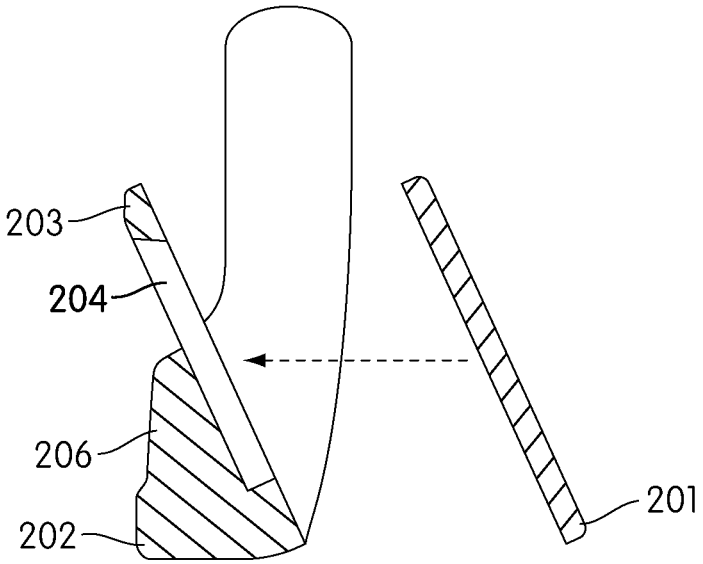
FIG. 4 illustrates an exploded view of the golf club head structure shown in FIG. 3.

FIGS. 2, 3 and 4 show an illustrative golf club head 200 which includes example features and structures that may be included in golf clubs and golf club head bodies in accordance with examples of this disclosure. FIG. 2 illustrates a rear view of the golf club head 200. FIG. 3 is a cross-sectional view of the golf club head 200 along line 3-3 shown in FIG. 2. FIG. 4 is an exploded view of the cross-sectional view shown in FIG. 3.

As seen in FIGS. 2 and 3, the golf club head 200 may include a ball striking face 201 and a golf club head body 202 which may include a perimeter weighting member 203. As shown in FIGS. 2 and 3, the perimeter weighting member 203 may extend in a direction rearwardly from the ball striking face 201 and along at least a portion of a circumferential area of the golf club head body 200.

According to aspects of the disclosure, the ball striking face 201 may be relatively thin. For example, according to aspects of the disclosure, the thickness of the ball striking face 201 may be in a range of: 0.080-0.110 inches, 0.080-0.095 of an inch, 0.085-0.090 of an inch, or 0.900-0.100 of an inch. Of course, other thicknesses may be used as well. Further, according to aspects of the disclosure, the ball striking face 201 may comprise a high strength alloy. For example, the ball striking face 201 may comprise SUP 10 steel alloy or SAE 8655 steel alloy. Of course, other materials may be used as well. It is noted that according to aspects of the disclosure, a high strength, resilient and durable material may be used so that the ball striking face 201 is able to withstand the repeated impacts with the golf ball and the general conditions of the golf course environment. For example, other metals, alloys, etc., or combinations thereof, may be used as desired.

According to aspects of the disclosure, the ball striking face 201 may be a separate element that is engaged with the golf club head body 202. For example, according to aspects of the disclosure, the ball striking face 201 may be welded to the golf club head body 202. For example, the ball striking face 201 may be welded to a front face of the golf club head body 202 around the perimeters of the front face of the golf club head body 202 and the ball striking face 201 (or at least a portion of the perimeters thereof). The perimeter, or "off the face" welding can contribute to providing the relatively thin ball striking face 201.

It is noted that according to aspects of the disclosure, the above described configuration of the ball striking face 201 (including the material comprising the ball striking face 201 and the methods of attached the ball striking face to the golf club head body 201) may provide a relatively high coefficient of restitution (COR) which may provide a relatively large amount of the ball speed when the golf ball leaves the ball striking face 201 after impact. For example, the COR may be in a range of 0.780-0.810. The larger amount of ball speed at impact may cause the golf ball to travel a farther distance after impact with the ball striking face 201.

Further, according to aspects of the disclosure, the ball striking face 201 may include one or more score lines. The score lines may interact with the dimpled surface of the golf ball during the impact of the golf club head 200 with a golf ball (e.g., during a golf swing) and affect the aerodynamics of the golf ball during the golf shot. For example, the score lines may cause a spin (e.g., back spin) of the golf ball during the golf shot.

As discussed above, according to aspects of the disclosure, the golf club head body 202 may be a separate element with which the ball striking face 201 is engaged (e.g., welded to the golf club head body 202 along at least a portion of the perimeter of the front face of the golf club head body 202).

According to aspects of the disclosure, the golf club head body 202 may have a volume in a range of: 28-40 cubic centimeters (cc), 28-32 cc, 33-38 cc or 39-40 cc. Of course, other sizes may be used as well. Further, according to aspects of the disclosure, the ball striking face 201 may be comprised of steel. For example, the golf club head body 202 may comprise carbon steel (e.g., 1020 or 1025 carbon steel). Of course, other materials may be used as well. For example, other metals, alloys, polymers, plastics, etc. or combinations thereof, may be used as desired.

According to aspects of the disclosure, the golf club head body 202 may include at least a portion of the perimeter weighting member 203 being tapered in the direction of the ball striking face 201 of the golf club head 200. Further, as seen in FIG. 2, according to aspects of the disclosure, the perimeter weighting member 203 may be tapered such that it exhibits a differently tapered surface, or ledge (e.g., an angled ledge which is angled in the direction of the ball striking face 201 at an angle different from the angle at which the remainder of the perimeter weighting member 203 extends in the direction of the ball striking face 201 of the golf club head 200). As shown in FIG. 2, the ledge may extend in a linear fashion across the perimeter weighting member 203 of the golf club head at level approximately ¼, ⅓, or ½ or more of the height of the perimeter weighting member 203.

According to aspects of the disclosure, the perimeter weighting member 203 of the golf club head may define an interior region of the golf club head 200 which is interior relative to the perimeter weighting member 203. According to aspects of the disclosure and, as shown in FIGS. 2-4, the golf club head body 200 may include a wall 206 that extends within the interior region of the golf club head body 200 in the toe to heel direction and between the inner edges of the perimeter weighting member 203. As shown in FIGS. 2-4, the wall 206 may be recessed, or set back from, the back edge of the perimeter weighting member 203. Further, as seen in FIGS. 2-4, the wall 206 may extend only upwards from the sole of the golf club head 200 and within the interior region of the golf club head body 200. For example, the wall may extend ¼, ⅓, or ½ or more of the height of the interior region of the golf club head 200 defined within the perimeter weighting member 203. According to aspects of the disclosure, the wall may have a height of 0.1-0.9 inches, 0.2-0.8 inches, 0.25-0.75 inches (as measured from the top of the portion of the perimeter weighting member 203 which extends along the sole of the club head body 200). Of course other heights may be used as desired. According to aspects of the disclosure, and as seen in FIG. 2, the top of the wall 206 may extend generally along the same line (or at the same level) as the above described ledge of the perimeter weighting member 303.

According to aspects of the disclosure, the lower part of the interior region (e.g., between the wall 206 and the ball striking face 201) may be hollow. Further, as most clearly seen in FIG. 4, according to aspects of the disclosure, the golf club head body 202 may include a notched configuration at a position opposite the ball striking face of the golf club head 201 which defines, at least in part, the above described wall 206. Therefore, upon the ball striking face 201 being engaged with the golf club head body 202, the above described notched configuration, may form a slot, or pocket cavity in the golf club head 200 between the ball striking face 201 and a least a portion of the golf club head body 202 (e.g., the wall 206). Hence, as seen in the depicted embodiment the slot, or pocket cavity 204 is positioned behind the ball striking face 201.

According to aspects of the disclosure, and as seen in FIGS. 2-4, at least some of the pocket cavity 204 may be exposed, such that the pocket cavity 204 is not sealed. For example, as seen in the depicted embodiment, a top of pocket cavity 204 may be exposed.

According to aspects of the disclosure, the pocket cavity 204 may have a width in the range of 1.0-3.0 inches, 2.00-2.75 inches or 2.45-2.50 inches. Further, according to aspects of the disclosure, the pocket cavity 204 may have a height in the range of 0.5-1.0 inches, 0.7-0.9 inches, 0.6-0.8 inches or 0.7-0.75 inches. Further, the pocket cavity 204 may have a depth (e.g., in the direction of the ball striking face 201 towards the rear of the golf club head) in the range of 0.08-0.12 inches. Of course other dimensions may be used as desired.

According to some aspects of this disclosure, the pocket cavity 204 can be used to alter (e.g., shift) the center of the gravity of the golf club head 200. For example, the size and positioning of the pocket cavity 204 may redistribute the mass and weight of the golf club head 200 (e.g., as compared to a differently configured golf club head without a pocket cavity) and, thereby, shift golf club head's center of gravity. Therefore, the pocket cavity can be selectively sized and positioned to control features of the club head's center of gravity. For example, by sizing and positioning the pocket cavity 204, the center of gravity of the club head 200 may be adjusted, vertically (e.g., in the crown to sole direction of the golf club head 200), horizontally (e.g., in the heel to toe direction of the golf club head 200) and in a depth direction (e.g., in a ball striking face to rear surface direction of the golf club head 200).

For illustrative purposes the golf club head 200 may have center of gravity denoted symbolically at reference numeral 205. Therefore, as seen in FIGS. 2 and 3, according to aspects of the disclosure, the center of gravity 205 of the illustrative golf club head 200 may be positioned in a range of 17.5-19.5 mm upwards from the sole of the golf club head, 6.0-8.5 mm rewards from the hosel of the golf club head (e.g., the axis of the hosel), and within 0-1.50 mm of the center of the ball striking face of the golf club head. This location of the center of gravity 205 of the club head body 200 can affect the trajectory and ball flight of a golf ball struck by the golf club.

For example, the above described configuration of such pocket cavity iron-type golf club heads may provide a center of gravity of the golf club head 205 in a position such as described above which is low, and, also, away from the ball striking face 201 of the golf club head 200. Such a configuration may aid a golfer in imparting a more lofted trajectory to the golf ball, or higher ball flight.

Further, the above described configuration of such pocket cavity irons may provide a center of gravity of the golf club head 205 in a position such as described above which is relatively lower relative to the center of the face of the golf club head 200. Additionally, the above described configuration of such pocket cavity irons may provide a center of gravity of the golf club head 205 in a position such as described above which is farther back and away from the ball striking face 201. Such features may increase the Moment of Inertia (MOI ($I_{ZZ}$)). Therefore, by positioning the center of gravity of the golf club head 205 lower behind the center of the ball striking face 201 of the golf club head 200 and farther back and away from the ball striking face 201 of the golf club head 200, the size of the "sweet spot" of the golf club head 200 (the area typically in the center of the ball striking face 201 of the golf club head 200, wherein the trajectory of the golf ball is maximized according to the particular characteristics of the golf club head 200) may be increased.

Also, by removing the material behind ball striking face 201 and, instead, providing the negative space of the slot or pocket cavity 204 which extends in accordance with the height, width and depth ranges discussed above, the above described configuration of such pocket cavity iron-type golf club heads may provide more forgiveness. For example, the errant trajectory of the golf ball when the golf ball struck off center of the ball striking face 201 of the golf club head 200 is minimized. For example, the errant trajectory of the golf ball during golf shots in which the golf ball is contacted closer to the sole of the golf club head (e.g., as compared with the sweet spot) will be minimized. Therefore, such a configuration of the golf club head may be particularly advantageous in "long" irons, as longer irons may be more difficult to hit properly and, additionally, the distance lost due the off-center contact (which is particularly greater for "long" irons as opposed "middle" or "short" irons) is minimized.

Hence, for the reasons discussed above, the above described configuration of the pocket cavity iron-type golf club head which includes the above described relatively thin ball striking face 201 (and its method of attachment) along with the pocket cavity 204 configuration may, therefore, provide a higher ball flight (e.g., by increasing launch angle) and more forgiving golf shot. Therefore, the distance the golf ball travels after impact may be increased. In view of the above, aspects of the disclosure are directed to "long" irons with golf club heads with the above described pocket cavity configuration. It is noted that the configuration of the pocket cavity iron-type golf club head may take on a variety of forms (e.g., different dimensions, etc.) without departing from the spirit of disclosure.

Figure 5:
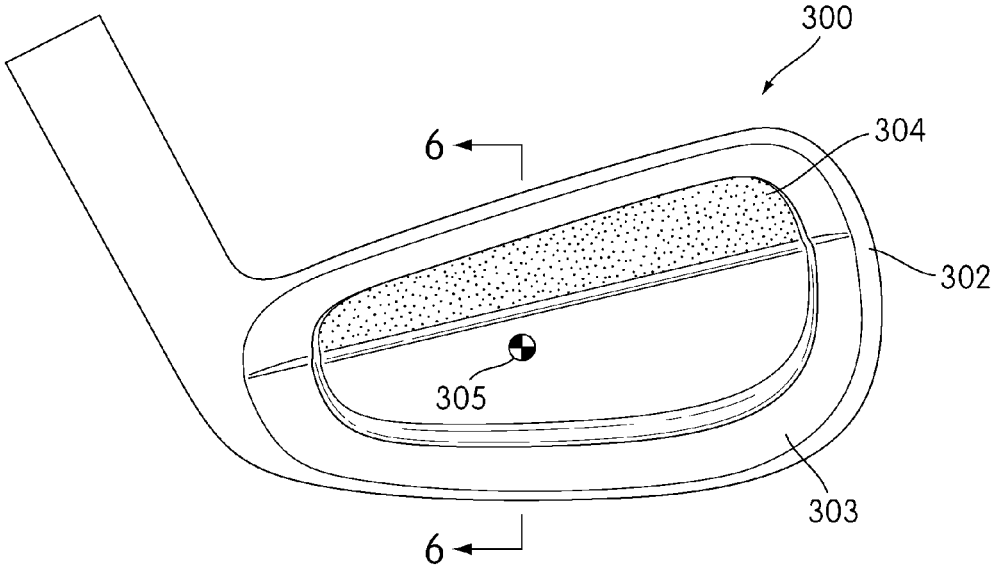
FIG. 5 illustrates a golf club head structure according to at least some examples of this disclosure.
Figure 6:
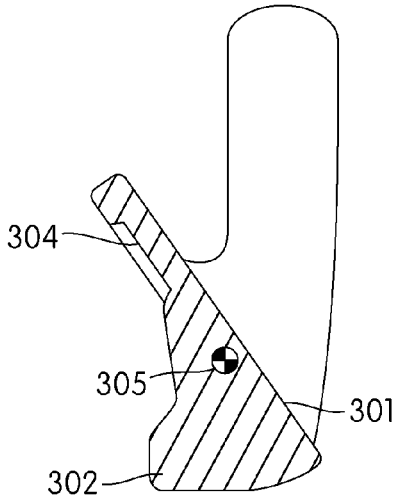
FIG. 6 illustrates cross sectional view of the golf club head structure shown in FIG. 5 taken along line 6-6.

FIGS. 5 and 6 show an illustrative golf club head 300 which includes example features and structures that may be included in golf clubs and golf club head bodies in accordance with examples of this disclosure. FIG. 5 illustrates a rear view of the golf club head 300. FIG. 6 is a cross-sectional view of the golf club head 300 along line 6-6 shown in FIG. 5.

As seen in FIGS. 5 and 6, the golf club head 300 may include a ball striking face 301 and a golf club head body 302 which may include a perimeter weighting member 303. As shown in FIGS. 5 and 6, the perimeter weighting member 303 may extend in a direction rearwardly from the ball striking face 301 and along at least a portion of a circumferential area of the golf club head body 302.

According to aspects of the disclosure, one or more elements of the golf club head 300, such as the ball striking face 301, the golf club head body 302 and the perimeter weighting member 303 maybe be formed as a single piece. For example, golf club head 300 may be cast or forged. Further, according to aspects of the disclosure, the golf club head 300 may be comprised a high strength metal. For example, the golf club head 300 may comprise a carbon steel (e.g., 1020 or 1025 carbon steel). Of course, other materials may be used as well. It is noted that according to aspects of the disclosure, a high strength, resilient and durable material may be used so as that the golf club head 300 is able to withstand the general conditions of the golf course environment. For example, other metals, alloys, polymers, plastics, etc., or combination thereof, may be used as desired. According to aspects of the disclosure, the golf club head 300 may have a volume in a range of: 28-40 cubic centimeters (cc), 28-32 cc, 33-38 cc or 39-40 cc. Of course, other sizes may be used as well.

According to aspects of the disclosure, the ball striking face 301 may include a face plate integrally formed with ball striking face 301 or otherwise engaged with ball striking face 301. Further, according to aspects of the disclosure, the ball striking face 301 (or faceplate) may include one or more score lines which provide the same function as discussed above with regard to the embodiment shown in FIGS. 2-4.

According to aspects of the disclosure, the golf club head 300 may include the split cavity or half cavity configuration wherein, at least a portion of, the perimeter weighting member 303 may be tapered in the direction of the ball striking face 301 of the golf club head 300. For example, according to aspects of the disclosure, the lower half of the perimeter weighting member 303 maybe be tapered in the direction of the ball striking face 301 of the golf club head 300. Further, as seen in FIG. 5, according to aspects of the disclosure, at least a part of the perimeter weighting member 303 may be tapered such that it exhibits a differently tapered surface, or ledge (e.g., an angled ledge which is angled in the direction of the ball striking face 301 at an angle different from the angle at which the remainder of the tapered section of the perimeter weighting member 303 extends in the direction of the ball striking face 301 of the golf club head 300). As shown in FIG. 5, the ledge may extend in a linear fashion across the perimeter weighting member 303 of the golf club head 300 at level approximately ¼, ⅓, or ½ or more of the height of the perimeter weighting member 303.

Additionally, the perimeter weighting member 303 of the golf club head 300 may define a recessed interior region of the golf club head 300 which is interior relative to the perimeter weighting member 300. The recessed interior region may include a notch 304 in the recessed interior region of the golf club head which extends through at least an upper quarter of the recessed interior region and positioned behind the ball striking face of the golf club head. Further, the notch 304 may extend through others areas of the interior region, such as the upper half of the interior region defined by the perimeter weighting member 303. As seen in FIG. 5, according to aspects of the disclosure, the lower boundary of the notch 304 may extend generally along the same line (or at the same level) as the tapered upper surface, or ledge, of the perimeter weighting member 303. Further, according to aspects of the disclosure, the notch 304 may have a depth in the range of 0.1-0.2 inches.

It is noted that the remaining part of the interior region (e.g., the lower half of the interior region within the recess defined by the perimeter weighting member 303) may be solid, or substantially solid. For example, in contrast to the above described pocket cavity configuration which may include a hollow lower region, the recessed interior region defined within perimeter weighting member 300 is filled and solid. In this way, as will be described below, the split cavity or half cavity configuration provides more control, feel and workability to the golf club head 300.

Further, it is noted that the lower region of the interior region may be thicker than the area defined by the notch, and the boundary between the notch and the lower region may be defined by a ledge that extends within the interior region of the golf club head body between inner edges of the perimeter weighting member in the toe to heel direction.

In such a split or half cavity configuration as described above, more mass and weight may be positioned lower in the club head body 300 (e.g., more mass and weight may be positioned in a lower half of the club head body 300 than in an upper half of the club head body). Therefore, according to some aspects of this disclosure, half cavity configuration can be used to alter (e.g., shift) the center of the gravity of the golf club head 300 lower in the golf club head and away from the ball striking face 301 of the golf club head 300. For example, according to aspects of the disclosure, by sizing and positioning the notch 304, the center of gravity of the club head 30 may be adjusted, vertically (e.g., in the crown to sole direction of the golf club head 300), horizontally (e.g., in the heel to toe direction of the golf club head 300) and in a depth direction (e.g., in a ball striking face to rear surface direction of the golf club head 300).

For example, the configuration and positioning of the notch 304 may redistribute the mass and weight of the golf club head 300 so that the mass and weight of the golf club head is lower in the golf club head and away from the ball striking face 301 of the golf club head 300 (e.g., as compared to a differently configured golf club head without a split cavity or half cavity configuration) and, thereby, shift golf club head's center of gravity lower and away from the ball striking face 301 of the golf club head 300.

For illustrative purposes the golf club head 300 may have center of gravity denoted symbolically at reference numeral 305. Therefore, as seen in FIG. 6, according to aspects of the disclosure the center of gravity 305 of the illustrative golf club head 300 may be positioned in a range of 18.0-19.5 mm upwards from the sole of the golf club head, 7.0-11.0 mm rearwards from the hosel of the golf club (e.g., the axis of the hosel), and within 0.0-1.5 mm of the center of the ball striking face of the golf club head. This location of the center of gravity 305 of the club head body 300 can affect the trajectory and ball flight of a golf ball struck by the golf club.

Further, the above described configuration of such split half cavity iron-type golf club heads may provide a center of gravity of the golf club head 305 in a position such as described above which is relatively centered relative to the center of the face of the golf club head. By positioning the center of gravity of the golf club head 305 substantially behind the center of the ball striking face 301 of the golf club head 300, the size of the "sweet spot" of the golf club head 300 may be increased. Therefore, by positioning the center of gravity of the golf club head 305 substantially behind the center of the ball striking face 301 of the golf club head 300, the errant trajectory of the golf ball is minimized when the golf ball struck off center of the ball striking face 301 of the golf club head 300.

Also, as described above, the split cavity or half cavity configuration provides an outer perimeter member 303, a notched upper potion of the interior region behind the ball striking face 301 and a filled and solid lower portion of the interior region behind the ball striking face 301. It is noted that the filled and solid lower portion of the interior region behind the ball striking face 301 may provide more feel, control and workability for the golf shot as compared with the above described pocket cavity irons (or, even, cavity backed irons in general). Therefore, such a split cavity or half cavity configuration provides a relative compromise between the forgiveness of the above described pocket cavity irons (or, even, cavity backed irons in general) and the feel, control and workability of the blade-type irons described below. Therefore, such a configuration of the golf club head may be particularly advantageous in "middle" irons, wherein golfer may wish to have more feel, control and workability in a golf shot, and not have as great a need for as much forgiveness as the golfer might in the longer iron.

In view of the above, aspects of the disclosure are directed to middle irons with golf club heads with the above described split cavity or half cavity configuration. It is noted that the configuration of the split cavity or half cavity iron-type golf club heads may take on a variety of forms (e.g., different dimensions, etc.) without departing from the spirit of disclosure. For example, according to some aspects of this disclosure, the indicator may include a back cover or medallion which is set in the notch 304 of the golf club head body 300.

Figure 7:
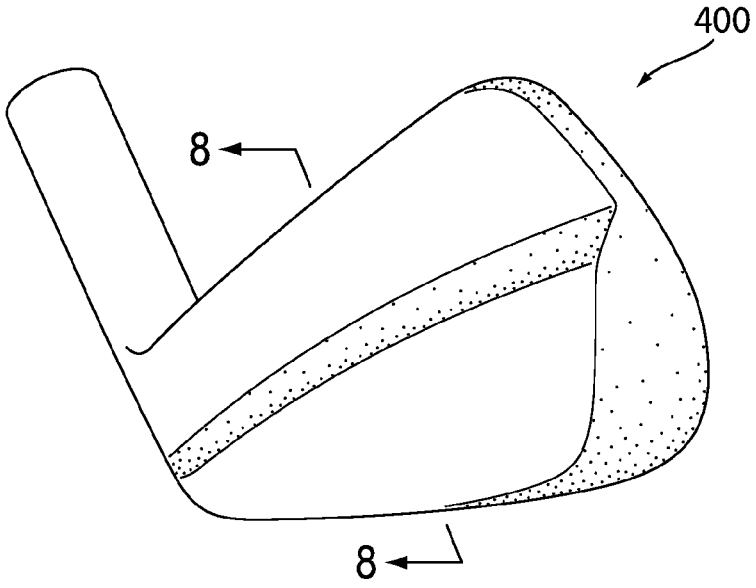
FIG. 7 illustrates a golf club head structure according to at least some examples of this disclosure.
Figure 8:
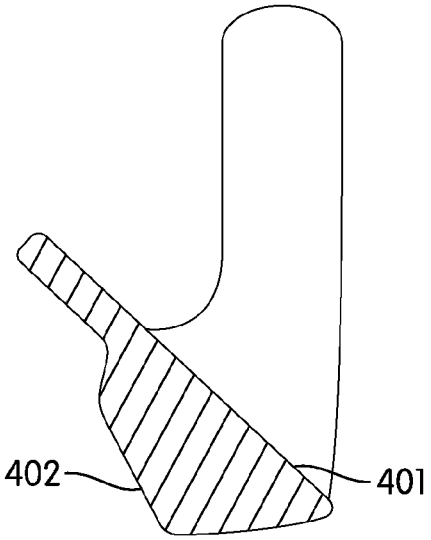
FIG. 8 illustrates cross sectional view of the golf club head structure shown in FIG. 7 taken along line 8-8.

FIGS. 7 and 8 show an illustrative golf club head 400 which includes example features and structures that may be included in golf clubs and golf club head bodies in accordance with examples of this disclosure. FIG. 7 illustrates a perspective view of the golf club head 400. FIG. 8 is a cross-sectional view of the golf club head 400 along line 8-8 shown in FIG. 7.

As seen in FIGS. 7 and 8, the golf club head 400 may be blade-type iron (or simply "blades") which includes a ball striking face 401 and a rear surface opposite the ball striking face 402. It is noted that, a blade-type iron may have a full back or rear surface (e.g., in contrast to a cavity back iron which has a cavity in the rear surface of the golf club, such as the cavity defined by a perimeter weighting member).

According to aspects of the disclosure, the golf club head 400 may be formed as a single piece. For example, golf club head 400 may be forged (or cast, if desired). Further, according to aspects of the disclosure, the golf club head 400 may be comprised a high strength metal. For example, golf club head may comprise a carbon steel (e.g., 1020 or 1025 carbon steel). Of course, other materials may be used as well. It is noted that according to aspects of the disclosure, a high strength, resilient and durable material may be used so as that the golf club head 400 is able to withstand the general conditions of the golf course environment. For example, other metals, alloys, etc. or combinations thereof may be used as desired.

According to aspects of the disclosure, the golf club head 400 may be a muscle back type blade (e.g., a blade in which more mass may be distributed around the sweet spot of the golf club head). Further, according to aspects of the disclosure, the golf club head 400 may have a volume in a range of: 28-40 cubic centimeters (cc), 28-32 cc, 33-38 cc or 39-40 cc. Of course, other sizes may be used as well.

According to aspects of the disclosure, the ball striking face 401 may include a face plate integrally formed with ball striking face 401 or otherwise engaged with the ball striking face 401. Further, according to aspects of the disclosure, the ball striking face 401 (or faceplate) may include one or more score lines which provide the same function as discussed above with regard to the embodiment shown in FIGS. 2-4.

In contrast to cavity back iron-type golf club heads in which mass and weight is distributed around the perimeter of the golf club head and, a blade distributes the mass and weight of the golf club head more evenly throughout the golf club head. Hence, as mentioned above a blade may have a smaller sweet spot compared with the larger sweet spot of the cavity back irons in which the perimeter weighting minimizes the extent of the errant trajectories during off center shots. Therefore, it may be more difficult to make contact with the sweet spot in a blade. However, because a blade distributes the mass and weight of the golf club head more evenly throughout the golf club head, the blade may provide a golfer with better "feel" and more control over the shot than a cavity backed iron. This feature of blade-type irons may be particularly advantageous in short irons wherein control and feel is particular useful.

Therefore, in view of the above, the above described blades may be particularly advantageous when employed in short irons. Hence, aspects of the disclosure are directed to short irons with golf club heads with the above described blade.

Aspects of this disclosure relate to a set of golf clubs which may include one, some or all of the above described iron-type golf club heads. For example, according to aspects of the disclosure, one or more of the long irons in the set may include the pocket cavity iron-type golf club heads described above. Further, one or more of the middle irons in the set may include the split cavity or half cavity iron-type golf club heads described above. Additionally, one or more of the short irons in the set may include the blade type, iron-type golf club heads described above.

By providing the a set of golf clubs with each of the above described types of the golf club heads, the golfer may be able to utilize the advantages of each of the types of the golf club heads in the set. For example, the pocket cavity configuration of FIG. 2-4 provides a lower center of gravity, more forgiveness, a low spin. Therefore, such a pocket cavity configuration may be used in the "long" irons of a set of golf clubs according to aspects of the disclosure, because such characteristics may be useful in "long" irons to aid a golfer in imparting a trajectory to the golf ball with less spin, further roll and a relatively longer ball flight which will tend to increase the distance that the golf ball will travel upon being struck by the golfer. For example, a golfer may be able to utilize the additional distance produced by the pocket cavity irons in hitting long shots.

Conversely, the blades shown in FIGS. 7 and 8 may provide more spin, less roll and more workability which tend to provide enhanced ball control (e.g., stopping the ball on the green). Therefore, such blades may be used in "short" irons of a set of golf clubs according to aspects of the disclosure, because such characteristics may aid a golfer in imparting a trajectory to the golf ball with more spin, less roll and a relatively higher ball flight which will tend to provide more ball control. For example, a golfer may be able to utilize the additional control and feel produced by the blades in hitting shots around the green.

Additionally, the half cavity iron-type golf club heads shown in FIGS. 5 and 6 may provide a lower center of gravity, and a relative compromise between the forgiveness of the pocket cavity irons and the control, feel and workability of the blades. Therefore, such a half cavity configuration may be used in the "middle" irons of a set of golf clubs according to aspects of the disclosure wherein such a compromise between such characteristics is particularly useful. Therefore, it is understood that providing the particular types of golf club heads described above may produce a set of golf clubs with desirable characteristics.

It is noted that while the particular set of golf clubs described above has pocket cavity configured golf club heads in long irons, split cavity or half cavity configured golf club heads in middle irons and blade-type golf club heads in short irons, other combinations may be used as desired. For example, any of the above described types of iron-type golf club head structure may be used in 0-10 irons, wedges (e.g., iron-type clubs having lofts from 44-68 degrees, such as pitching wedges, lob wedges, sand wedges, gap wedges, etc.), etc. Further, in accordance with at least some examples of this disclosure, golf clubs and/or golf club heads in accordance with examples of this disclosure may be sold or marketed as a set including plural irons, including, for example, sets having 0-10 irons, pitching wedges, lob wedges, sand wedges, gap wedges, and/or chipping clubs. When present in a set, any desired number of the clubs in the set may have one or more of the three types of golf club heads in accordance with this disclosure. In some more specific examples, sets of golf clubs in accordance with this disclosure may contain at least the 3-9 irons and a pitching wedge, wherein at least two of these irons (and in some examples, all of these irons) will have a golf club head in accordance with examples of this disclosure. As another example, sets of golf clubs in accordance with this disclosure will contain at least the 4-9 irons (or even 5-9 irons or 6-9 irons) and a pitching wedge, and optionally a sand wedge and/or one or more iron-type hybrid clubs, wherein at least two of these clubs (and in some examples, all of these irons) will have a golf club head in accordance with examples of this disclosure.

Figure 9:
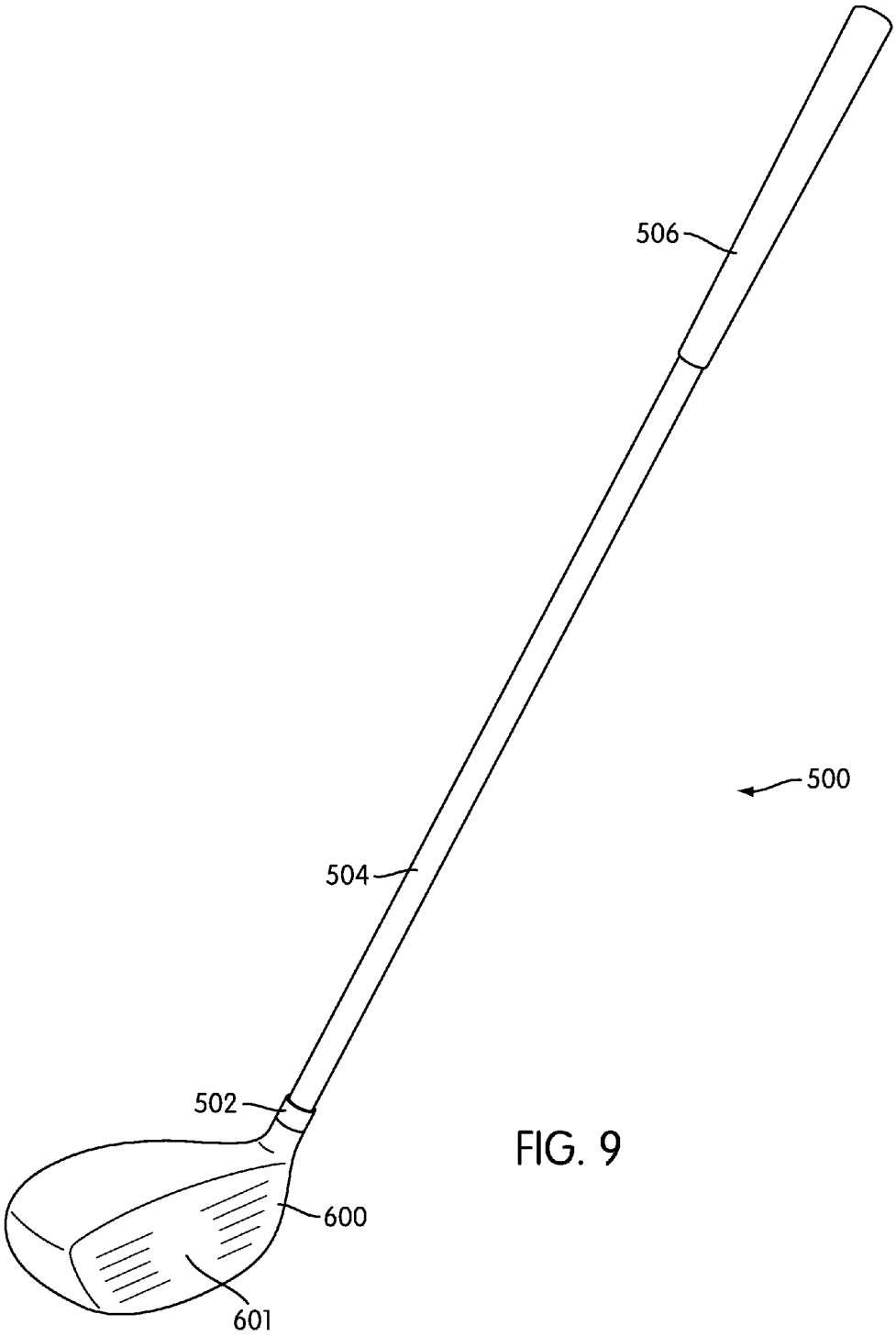
FIG. 9 illustrates features of a golf club structure according to at least some examples of this disclosure.
Figure 10:
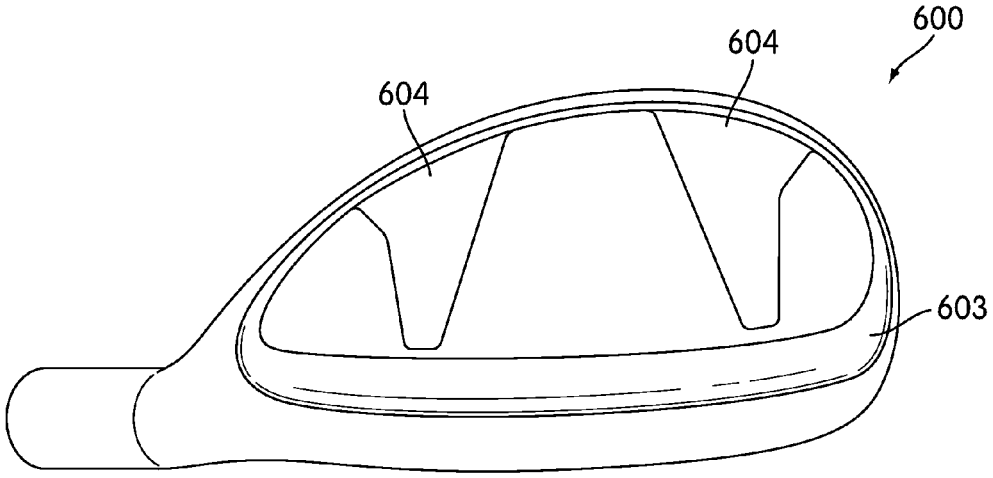
FIG. 10 illustrates features of a bottom view of a golf club head structure according to at least some examples of this disclosure.
Figure 11:
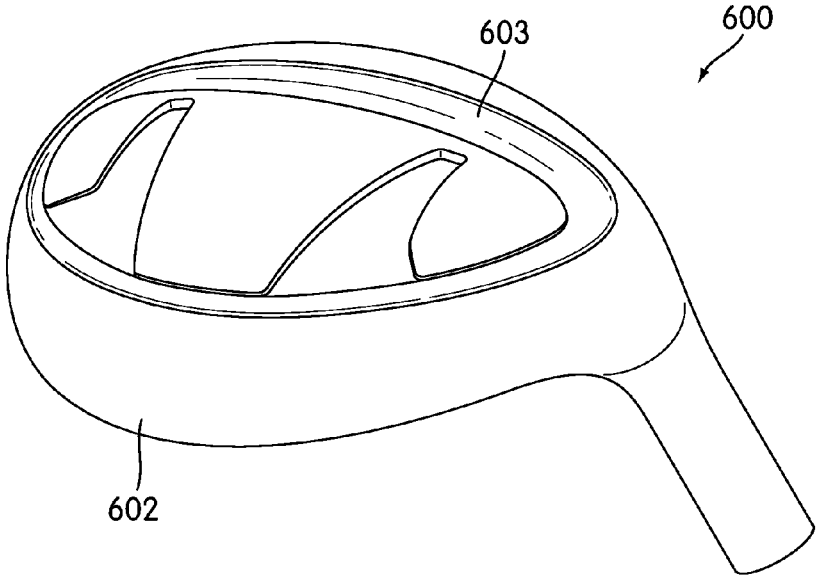
FIG. 11 illustrates a perspective view of the golf club head structure shown in FIG. 10.

Aspects of this disclosure relate to hybrid-type golf club heads. FIG. 9 generally illustrates an example of a hybrid-type golf club 500 in accordance with the disclosure. The overall golf club structure 500 of this example includes, a hosel 502, a shaft 504 received in and/or inserted into and/or through the hosel 502, a grip or handle 506 attached to the shaft 504 and a golf club head. Further, the golf club structure 500 may include a hybrid-type golf club head 600. FIG. 10 shows a bottom view of the illustrative golf club head 600 which includes example features and structures that may be included in golf clubs and golf club head bodies in accordance with examples of this disclosure.

The golf club head 600 itself also may be constructed in any suitable or desired manner and/or from any suitable or desired materials without departing from this disclosure, including from conventional materials and/or in conventional manners known and used in the art. For example, wide varieties of overall club head constructions are possible without departing from this disclosure. For example, if desired, some or all of the various individual parts of the club head body described above may be made from multiple pieces that are connected together (e.g., by adhesives or cements; by welding, soldering, brazing, or other fusing techniques; by mechanical connectors; etc.). The various parts (e.g., crown, sole, ball striking face, aft body, body ribbon members, etc.) may be made from any desired materials and combinations of different materials, including materials that are conventionally known and used in the art, such as metal materials, including lightweight metal materials (e.g., titanium, titanium alloys, aluminum, aluminum alloys, magnesium, magnesium alloys, etc.), composite materials, polymer materials, etc. The club head body and/or its various parts may be made by forging, casting, molding, machining, and/or using other techniques and processes, including techniques and processes that are conventional and known in the art.

According to some aspects of the disclosure, the dimensions of the golf club head 600 may include a volume between 90-150 cubic centimeters. As seen in FIGS. 9 and 10, the club head body 600 of this illustrated example may include a ball striking face 601 on a front side thereof, a rear side 602 opposite the front side, a crown and a sole. As further seen in FIG. 10, the golf club head body 102 may have a generally traditionally rounded shape (although this is not required). Further, it is noted that, according to aspects of the disclosure, the ball striking face 601 may include a ball striking face plate integrally formed with the ball striking face 601 or otherwise engaged ball striking face 601.

As seen in FIG. 10, according to aspects of the disclosure, the golf club head 600 may include a cavity, or compression channel 603. According to aspects of the disclosure, the cavity, or compression channel 603, may extend through a bottom surface of the club head body 600 behind the ball striking face 601 of the golf club head 600. The compression channel 603 may allow the golf club head 600 to compress during impact with the golf ball and, thereby, increase ball speed on low heel to center shots. Therefore, the compression channel 603 of the golf club head 600 may be particularly useful in maximizing the distance on off center shots.

According to aspects of the disclosure, the compression channel 603 may extend around the perimeter of the sole and rear of the golf club head 600. Further, according to aspects of the disclosure, the width of the compression channel 603 behind the ball striking face 601 may be in the range of: 0.1-0.4 inches, 0.2-0.3 inches, or 0.25 inches. Of course, other ranges may be used as desired. Further, the depth of the compression channel 603 behind the ball striking face 601 may be in the range of several millimeters.

Further, the golf club head body may include one or more additional cavities extending through a bottom surface of the club head. For example, in the depicted embodiment, the golf club head 600 may include two cavities 604 positioned in the sole of the golf club head. As seen the depicted embodiment, the cavities 604 may be positioned behind the compression channel 603 and extend towards the rear of the golf club head 600. According to aspects of the disclosure, the depth of the cavities 604 may be in the range of several millimeters. Of course, other ranges may be used as desired.

Further, in accordance with at least some examples of this disclosure, golf clubs and/or golf club heads in accordance with examples of this disclosure may be sold or marketed as a set including plural irons, including, for example, sets having one or more of iron-type hybrid clubs (such as described above), driving irons, 0-10 irons, pitching wedges, lob wedges, sand wedges, gap wedges, and/or chipping clubs. When present in a set, any desired number of the clubs in the set may have a club head in accordance with this disclosure. In some more specific examples, sets of golf clubs in accordance with this disclosure may contain at least the 3-9 irons and a pitching wedge, wherein at least 1 of these irons (and in some examples, all of these irons) will have a golf club head in accordance with examples of this disclosure and at least 1 hybrid type golf club head in accordance with examples of this disclosure. As another example, sets of golf clubs in accordance with this disclosure will contain at least the 4-9 irons (or even 5-9 irons or 6-9 irons) and a pitching wedge, and optionally a sand wedge and/or one or more iron-type hybrid clubs (such as described above), wherein at least 2 of these clubs (and in some examples, all of these clubs) will have a golf club head in accordance with examples of this disclosure.

III. Conclusion

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims. For example, the various features and concepts described above in conjunction with FIGS. 1 through 10 may be used individually and/or in any combination or subcombination without departing from this disclosure.

We claim:

1. A set of iron-type golf clubs comprising at least two iron-type golf clubs with iron-type golf club heads, wherein at least one of the two iron-type golf club heads includes: a first type of iron-type golf club head, which includes: a ball striking face; a golf club head body; a perimeter weighting member extending in a direction rearwardly from the ball striking face and along at least a portion of a circumferential area of the golf club head body; a recessed interior region of the golf club head which is defined by the perimeter weighting member and which is interior relative to the perimeter weighting member; a wall which is set back from a rear edge of the perimeter weighting member and which extends within the interior region of the golf club head body between inner edges of the perimeter weighting member in the toe to heel direction and upwards from a sole of the golf club head to cover at least a quarter of the interior region of the golf club head defined within the perimeter weighting member; and a slot contained within the recessed interior region defined by the perimeter weighting member, wherein the slot is positioned behind the ball striking face and defined by the ball striking face and the wall; wherein at least one of the two iron-type golf club heads includes: a second type of iron-type golf club head, which includes: a ball striking face; a golf club head body; a perimeter weighting member extending in a direction rearwardly from the ball striking face and along at least a portion of a circumferential area of the golf club head body; a recessed interior region of the golf club head which is defined by the perimeter weighting member and which is interior relative to the perimeter weighting member and includes: a notch in the recessed interior region of the golf club head which extends through at least an upper quarter of the recessed interior region and positioned behind the ball striking face of the golf club head; and a lower section of the interior region which is includes the remaining portion of the recessed interior region and is solid and thicker than the area defined by the notch, wherein the boundary between the notch and the lower region is defined by a ledge that extends within the interior region of the golf club head body between inner edges of the perimeter weighting member in the toe to heel direction, wherein the perimeter weighting member is tapered in the direction of the ball striking face of the golf club head and at least a section of the perimeter weighting member is tapered such that it exhibits a ledge which is angled at an angle which is different from the angle at which the remainder of the tapered section of the perimeter weighting member extends in the direction of the ball striking face of the golf club head; wherein the boundary extends generally along the line as the ledge of the perimeter weighting member.

2. A set of iron-type golf clubs according to claim 1, further comprising at least a third iron-type golf club with an iron-type golf club head, wherein the third type of iron-type golf club head is a blade type golf club head.

3. A set of iron-type golf clubs according to claim 2, wherein the set of golf clubs includes a 3 iron and a 4 iron and the 3 iron and the 4 iron each include the first type of golf club head.

4. A set of iron-type golf clubs according to claim 3, wherein the set of golf clubs includes a 5 iron, a 6 iron and a 7 iron, and the 5 iron, the 6 iron and the 7 iron each include the second type of golf club head.

5. A set of iron-type golf clubs according to claim 4, wherein the set of golf clubs includes an 8 iron, a 9 iron and one or more wedges, and the 8 iron, the 9 iron and the one or more wedges each include the blade type of golf club head.

6. A set of iron-type golf clubs according to claim 1, wherein the slot has a height in the range of 0.7-0.9 inches and depth in the range of 0.08-0.12 inches.

7. A set of iron-type golf clubs according to claim 1, wherein the ball striking face of the first type of golf club head is welded onto the first golf club head body and the ball striking face of the second type of golf club head is formed integrally with the second golf club head body.

8. A set of iron-type golf clubs according to claim 7, wherein the ball striking face has a thickness in the range of 0.09-0.11 inches.

9. A set of iron-type golf clubs according to claim 2, wherein a center of gravity of the first type of golf club head is positioned in a range of 17.5-19.5 mm upwards from the sole of the golf club head, 6.0-8.5 mm rearwards from the hosel and within 0.0-1.50 mm of the center of the ball striking face of the golf club head.

10. A set of iron-type golf clubs according to claim 1, wherein the set of golf clubs includes a 3 iron a 4 iron and a 5 iron and the 3 iron, the 4 iron and 5 iron each include the first type of golf club head.

11. A set of iron-type golf clubs according to claim 10, wherein the set of golf clubs includes a 6 iron, a 7 iron, an 8 iron, a 9 iron and one or more wedges and the 6 iron, the 7 iron, the 8 iron, the 9 iron and the one or more wedges each include the second type of golf club head.

12. A golf club kit comprising: a set of golf clubs which includes at least three iron-type golf clubs with iron-type golf club heads, and at least one hybrid-type golf club with a hybrid type golf club head, wherein at least one of the three iron-type golf club heads includes: a first type of iron-type golf club head, which includes: a ball striking face; a golf club head body; a perimeter weighting member extending in a direction rearwardly from the ball striking face and along at least a portion of a circumferential area of the golf club head body; a recessed interior region of the golf club head which is defined by the perimeter weighting member and which is interior relative to the perimeter weighting member; a wall which is set back from a rear edge of the perimeter weighting member and which extends within the interior region of the golf club head body between inner edges of the perimeter weighting member in the toe to heel direction and upwards from a sole of the golf club head to cover at least a quarter of the interior region of the golf club head defined within the perimeter weighting member; and a slot contained within the recessed interior region defined by the perimeter weighting member, wherein the slot is positioned behind the ball striking face and defined by the ball striking face and the wall; wherein at least one of the three iron-type golf club heads includes: a second type of iron-type golf club head, which includes: a ball striking face; a golf club head body; a perimeter weighting member extending in a direction rearwardly from the ball striking face and along at least a portion of a circumferential area of the golf club head body; a recessed interior region of the golf club head which is defined by the perimeter weighting member and which is interior relative to the perimeter weighting member and includes: a notch in the recessed interior region of the golf club head which extends through at least an upper quarter of the recessed interior region and positioned behind the ball striking face of the golf club head; and a lower section of the interior region which is includes the remaining portion of the recessed interior region and is solid and thicker than the area defined by the notch, wherein the boundary between the notch and the lower region is defined by a ledge that extends within the interior region of the golf club head body between inner edges of the perimeter weighting member in the toe to heel direction, wherein the perimeter weighting member is tapered in the direction of the ball striking face of the golf club head and at least a section of the perimeter weighting member is tapered such that it exhibits a ledge which is angled at an angle which is different from the angle at which the remainder of the tapered section of the perimeter weighting member extends in the direction of the ball striking face of the golf club head; wherein the boundary extends generally along the line as the ledge of the perimeter weighting member, wherein at least one of the three iron-type golf club heads includes: a third type of iron-type golf club head, wherein the third type of iron-type golf club head is a blade type golf club head; and wherein the at least one hybrid type golf club head includes: a ball striking face; and a golf club head body, wherein the golf club head includes a cavity, or channel, extending through a bottom surface of the club head body behind the ball striking face of the golf club head and one or more additional cavities extending through a bottom surface of the club head wherein the one or more additional cavities are positioned behind the cavity, or channel, and extend towards the rear of the golf club head.

* * * * *